United States Patent [19]

Bogdanski et al.

[11] 4,121,403

[45] Oct. 24, 1978

[54] FLAT MAIL SORTER AND LOADER

[75] Inventors: John J. Bogdanski, Stamford; Frank R. Chiappetta, Oxford; Gerald C. Freeman, Darien, all of Conn.

[73] Assignee: Pitney-Bowes, Inc., Stamford, Conn.

[21] Appl. No.: 830,934

[22] Filed: Sep. 6, 1977

[51] Int. Cl.[2] ..... B65B 11/00

[52] U.S. Cl. ..... 53/202; 198/399; 198/400

[58] Field of Search ..... 214/1 M; 198/395, 400, 198/399; 209/111.7 R, DIG. 1; 53/202; 101/2

[56] References Cited

U.S. PATENT DOCUMENTS

| | | | |
|---|---|---|---|
| 3,757,939 | 9/1973 | Henig | 209/DIG. 1 |
| 3,782,541 | 1/1974 | Wood | 214/1 M |
| 3,938,435 | 2/1976 | Suda et al. | 209/DIG. 1 |

*Primary Examiner*—Allen N. Knowles

*Attorney, Agent, or Firm*—Donald P. Walker; William D. Soltow, Jr.; Albert W. Scribner

[57] ABSTRACT

Apparatus for sorting flat mail bearing postage indicia adjacent one corner thereof. Pieces bearing postage indicia adjacent their leading edges are selectively sent to first or second transfer stations according to whether the indicia is adjacent the top or bottom edge. The pieces are caused to fall from the first or second transfer stations onto a common conveyor in such a fashion that all pieces on the conveyor are similarly positioned.

Those pieces wherein the postage indicia are disposed adjacent their trailing edges are directed to third and fourth stations. The third and fourth stations operate similarly to the first and second stations to position the pieces uniformly on a second conveyor. Each of the first and second conveyors supplies a first and second loading station. At these stations postal trays are automatically filled with mail from the respective conveyors and thereafter the filled trays are deposited in uniform relationship upon a common conveyor.

23 Claims, 5 Drawing Figures

FLAT MAIL SORTER AND LOADER

BACKGROUND OF THE INVENTION

There is a great need to decrease the cost of handling mail by the postal service, particularly in large metropolitan areas. To this end, there have been devised a number of automated devices for sorting, stacking, and otherwise handling mail pieces to meet certain preselected requirements. The present invention is directed to that class of apparatus which positions flat mail pieces in response to the location of the postage indicia and stacks the mail pieces into postal trays with all pieces similarly aligned. The prior art devices for sorting mail in response to the location of postage indicia have been unduly complex, expensive, or otherwise unsatisfactory. The disclosures of the following U.S. patents are representative of such devices:

U.S. Pat. No. 2,894,626 Mulders et al.

This device senses the vertical position of a stamp on an edge-traveling piece of mail and directs the mail piece either directly to a stamp canceling device or through a turnover device. The turnover device is a pair of crossed belts. There are certain problems inherent in crossed belt turnover devices. While they will handle standard letters, their twisting action may cause damage to items such as photographs contained within the envelopes. Furthermore, they are relatively useless for handling particularly large, stiff, or bulky items.

U.S. Pat. No. 2,895,588 — Van Marle

The disclosure of this patent is directed to a very complex device for facing mail which employs rotational conveyors as illustrated in FIGS. 6 and 13.

U.S. Pat. No. 2,984,349 of Mathis is also quite complex, employing pivoted friction rollers for sorting purposes.

U.S. Pat. No. 3,140,780 of Richert et al. is also relatively complex in employing suction devices to guide mail into and along selected paths.

It will, accordingly, be apparent that a need exists for simple and less expensive mail aligning apparatus and also for such apparatus which will handle mail pieces which cannot be processed by conventional letter mail equipment. One class of mail to which this invention is particularly directed is defined by the postal service as "flats" and may be 3–15 inches in height, 4¼–15 inches in length and 0.006 to 0.50 inches in thickness.

Accordingly, it is a primary object of the present invention to provide apparatus for sorting postal flats in accordance with the position of postage indicia thereon. Other objects are to provide such apparatus which is capable of automatically loading said pieces into postal trays; and to provide such apparatus which is simple, inexpensive, and reliable in operation. Other objects, features, and advantages will become apparent from the following description and appended claims.

SUMMARY OF THE INVENTION

The invention comprises apparatus for orienting flat mail pieces which are serially received in a generally edge-standing configuration bearing corner positioned postage indicia which are commonly adjacent either the leading or trailing edges. It includes means for sensing the location of the postage indicia relative to the vertical dimension of each piece and transporting mail pieces having the indicia located adjacent the upper edge in a first direction to a first transfer station. It further includes means for transporting pieces having indicia located adjacent the lower edge in a second direction to a second transfer station. Means are provided for conveying mail pieces away from the first and second transfer stations in a third direction. The first transfer station includes means for depositing mail pieces onto the conveying means in a preselected orientation relative to the third direction and means at the second transfer station for similarly depositing mail pieces onto the conveying means.

The invention also encompasses apparatus for loading flat mail pieces bearing corner positioned postage indicia in either of two orientations into receptacles which are in either of two loading positions and thereafter discharging the loaded receptacles with uniformly faced mail therein. To this end, there is provided a first loading station and means for conveying mail pieces to the first loading station with each having its postage indicia positioned on its upper surface adjacent the trailing edge relative to its direction of motion. Means are provided for sequentially supplying receptacles for loading at the first loading station. The loaded receptacles are discharged from the first loading station with a preselected orientation relative to the postage indicia locations of the mail pieces therein. Additionally, there is provided a second loading station and means for conveying mail pieces to the second loading station, each having its postage indicia on its lower surface adjacent its trailing edge. Similar means are provided for sequentially supplying receptacles at the second loading station and discharging loaded receptacles from the second loading station with the same orientation as receptacles from the first loading station.

DESCRIPTION OF THE PREFERRED EMBODIMENT

Transport Apparatus

Figure 1:
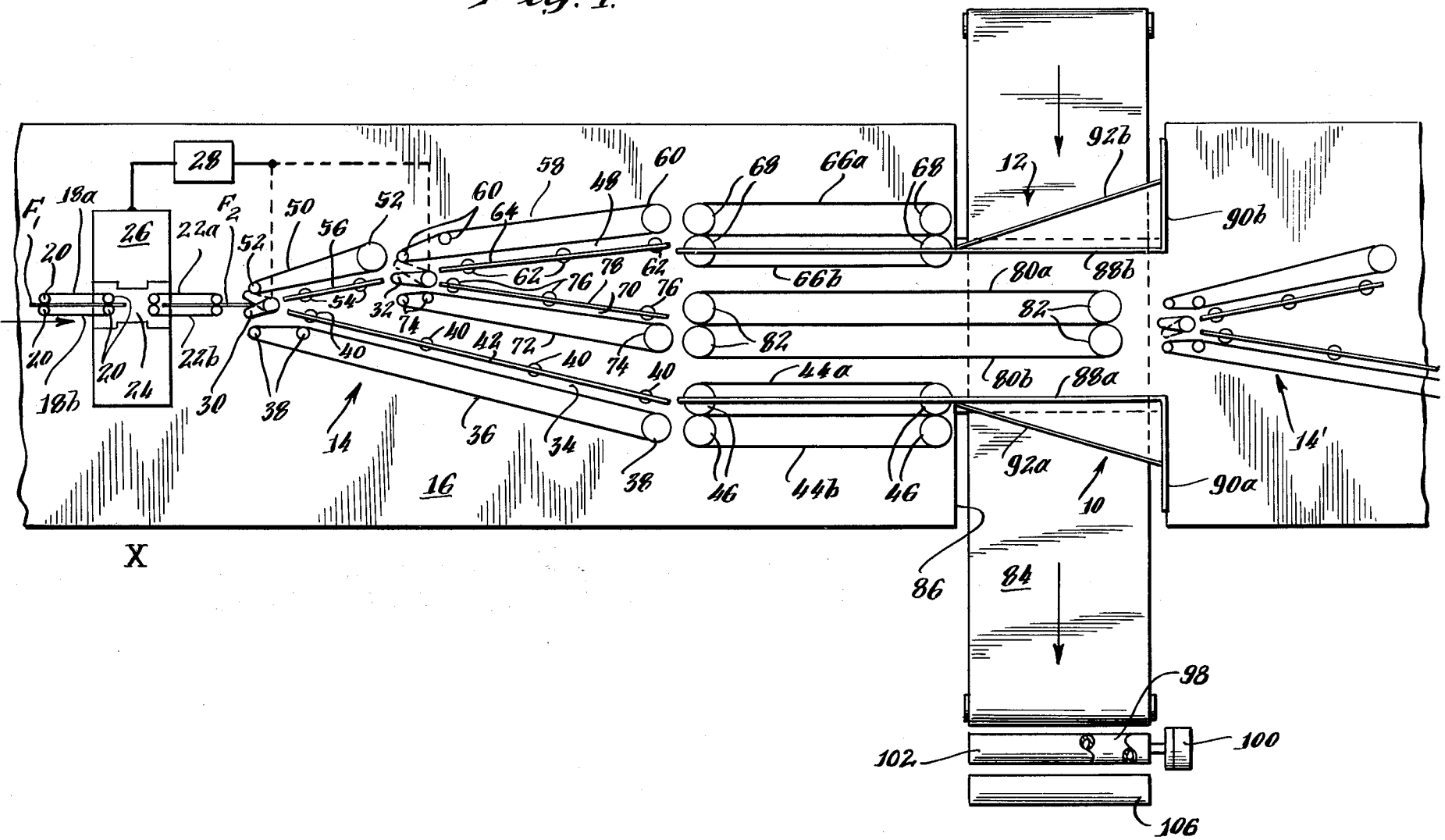
FIG. 1 is a plan view of a pair of transfer stations in accordance with this invention, including means for propelling mail pieces to said stations via desired pathways.

With particular reference to FIG. 1, there is illustrated a first 10 and a second 12 transfer station, together with transport apparatus 14 for selectively delivering mail pieces thereto. Mail flats are delivered to the transfer stations in an edge-standing configuration resting upon a horizontal, relatively low friction surface 16. The flats are conveyed to the transfer stations via a plurality of passageways formed by friction belts and movable gates. At the left end of FIG. 1, there are illustrated a pair of flats F1, F2 being sequentially advanced into the transport apparatus. The flat F1 is shown as held between a pair of belts 18*a*, 18*b* mounted upon suitable drive and idler rollers 20 to propel the flat in the direction of the arrow from left to right. A pair of similar belts 22*a, b* are positioned slightly "downstream" from the first set so as to leave a gap 24 therebetween. Positioned to view a flat passing through gap 24 is a photodetector 26 which is of conventional design. The photodetector 26 has the ability to detect postage indicia and determine whether it is at the leading edge or trailing edge, and along the upper or lower edge of each flat. A controller 28 receives the output of the photodetector 26 and controls the position of a pair of pivoted gates 30, 32.

From belts 22 each flat traverses one of three paths. A first path 34 leads to first transfer station 10 and includes a first section defined by a belt 36 mounted on suitable rollers 38 and a plurality of idler rollers 40 mounted in a vertical guide wall 42. The second section of path 34 is defined by belts 44*a, b,* mounted on rollers 46 leading directly into first transfer station 10.

A second path 48 leads to second transfer station 12 and includes a first portion defined by a belt 50 mounted on rollers 52 and idler rollers 54 mounted in a guide wall 56. The second section of second path 48 is defined by belt 58 mounted on rollers 60 in cooperation with idler rollers 62 in guide wall 64. The third and final section of second path 48 is defined by belts 66*a, 66b* mounted on rollers 68 and leading directly into second transfer station 12.

A third, or reject, path 70 includes the first section of path 48 and is thereafter defined by a belt 72 on rollers 74 cooperating with idler rollers 76 in a guide wall 78. The final portion of reject path 70 is defined by belts 80*a, 80b* on rollers 82 and extends between and beyond the first and second transfer stations.

Passing beneath the first 10 and second 12 transfer stations and substantially perpendicular to the paths formed by the transport apparatus is a conveyor belt 84. In addition, and downstream from the reject path 70, is the entrance to a second transport apparatus 14' substantially identical with transport apparatus 14 previously described.

Transfer Stations

Figure 2:
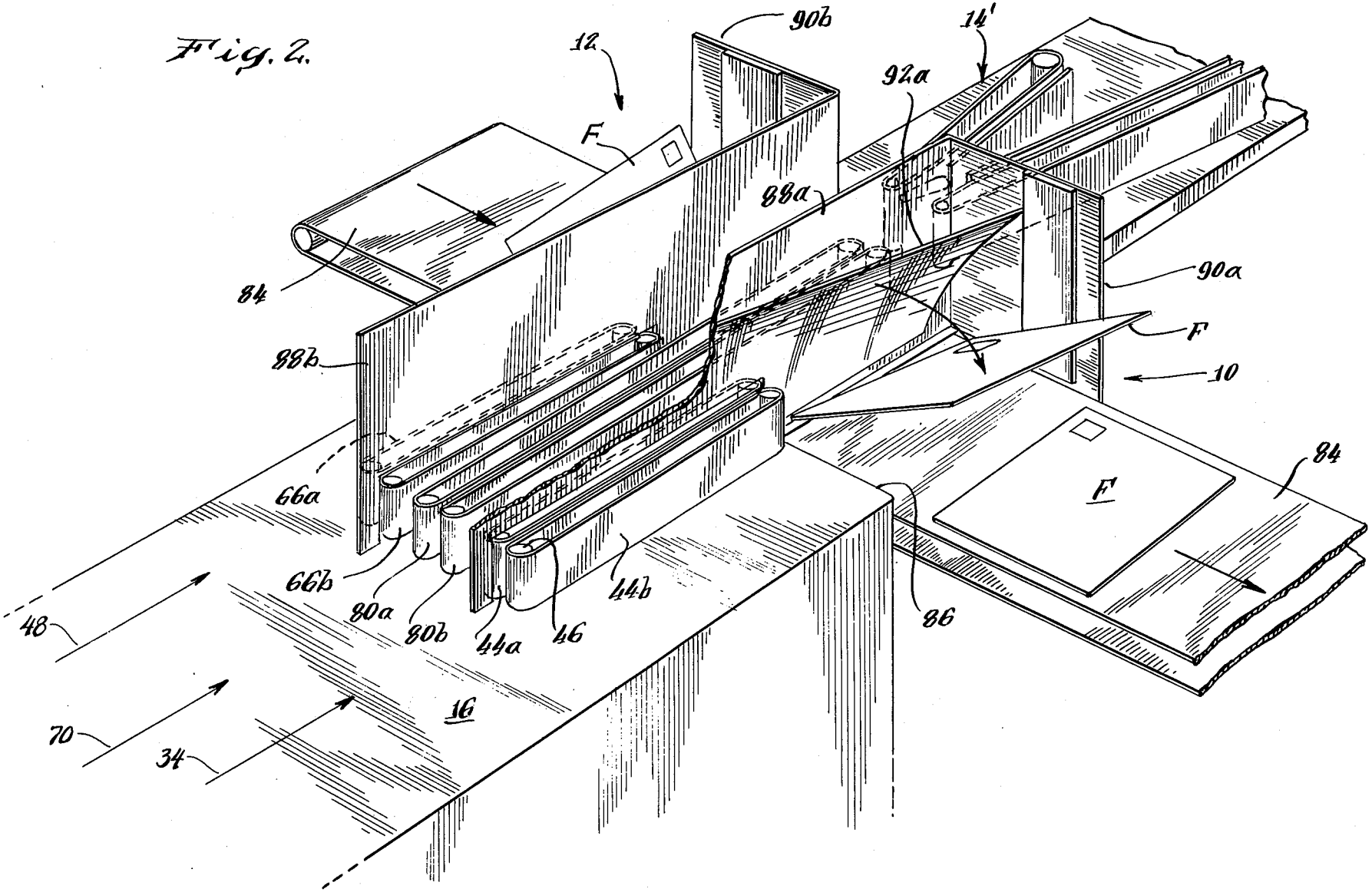
FIG. 2 is a perspective view of the transfer stations of FIG. 1, portions thereof being broken away to illustrate their construction.

The first transfer station 10 and second transfer station 12 are substantially identical although reversed. They are illustrated in detail in FIG. 2. It will be noted from FIG. 2 that the surface 16 is inletted to define an aperture 86 over the conveyor belt 84. Extending beyond the aperture 86 is a vertical wall 88*a* which is L-shaped to define a stop wall 90*a*. Transfer station 12 has a similar, but reversed, construction including wall 88*b* and stop wall 90*b*. Mounted across the angle between walls 88 and 90 is a curved metal deflector 92. The deflector 92, which is included in both transfer stations, has a somewhat plow-shaped contour so as to receive and deflect edge-standing flats from the respective paths 34 and 48. Flats which are not selected to pass through either of the first or second transfer stations pass between the stations in belts 80 as illustrated in FIG. 2.

As previously explained, a third and fourth transfer station, which are substantial duplicates of the first and second transfer stations, are located downstream. Because of the similarity in construction, they are not illustrated in detail. However, leading from the third and fourth transfer station is a conveyor 84' which extends parallel to conveyor 84 as illustrated in FIG. 3.

Loading Stations

Figure 3:
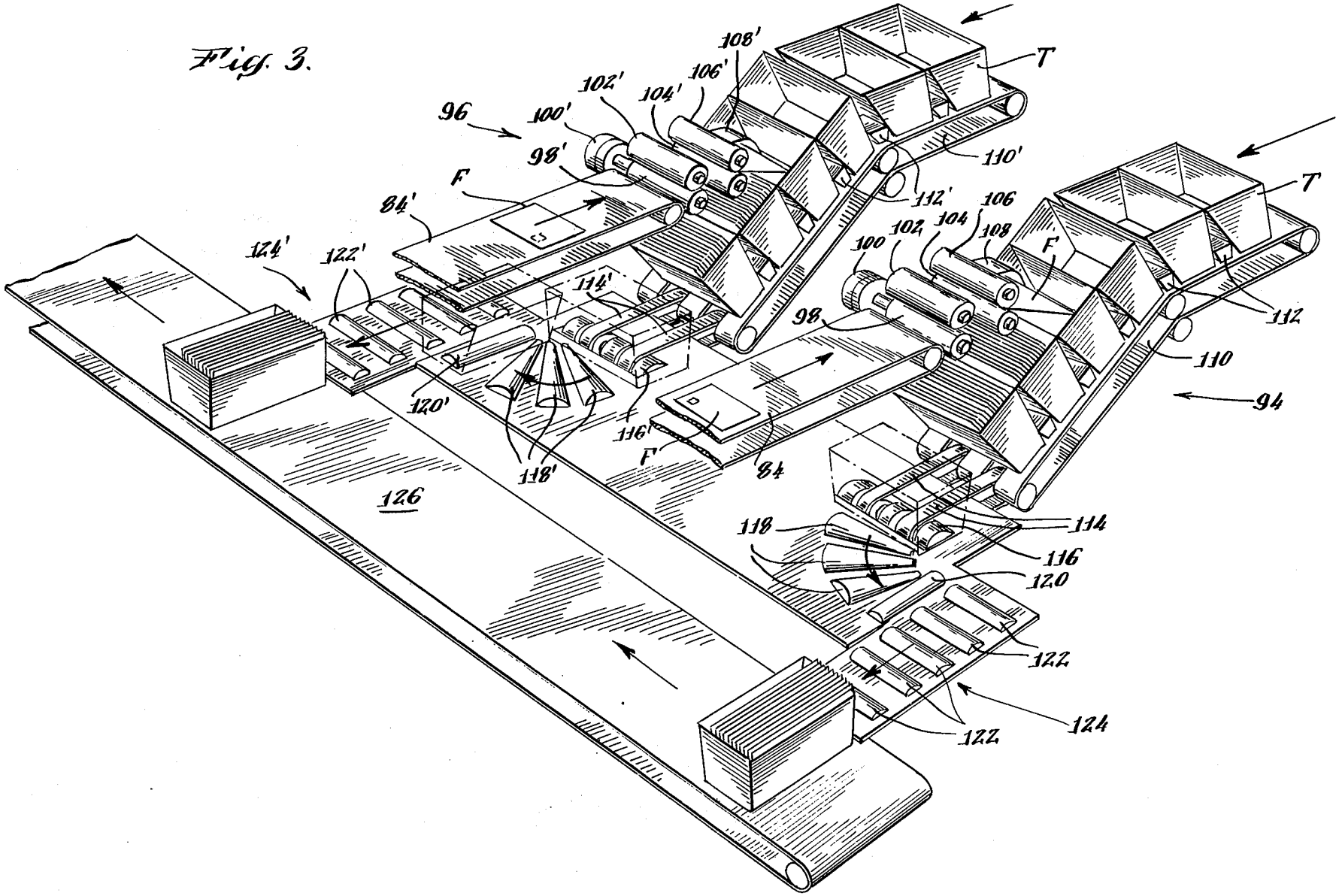
FIG. 3 is a perspective view of first and second loading stations in accordance with the invention.

There are illustrated in FIG. 3 a first loading station 94 and a second loading station 96, which are substantially identical. Accordingly, only station 94 will be described in detail and similar reference numerals with a prime (') attached will be employed for loading station 96.

Station 94 receives mail pieces from the first and second transfer stations via conveyor 84 and station 96 receives similar mail pieces from the third and fourth transfer stations via conveyor 84'. Just downstream from the end of conveyor 84 is a drive roller 98 powered by a brake/clutch drive 100 and in contact with an upper drag roller 102. Just downstream from the rollers 98 and 102 are a pair of ejector rollers 104 and 106. Extending at an angle downwardly from just above the bite between the rollers 104, 106 is a guide plate 108. Mounted below the ejector rollers 104, 106 is an inclined conveyor 110 upon which may be positioned a plurality of conventional postal trays T (as by means of separating cleats 112) for movement downwardly and beneath the ejector rolls.

At the bottom of the inclined conveyor 110 is a short horizontal conveyor formed by a pair of belts 114 which terminate at a roller 116. Just beyond roller 116 there are positioned a plurality of conical rollers 118 which are commonly powered in conventional fashion and are oriented with their apexes sharing a common point. They lead to a powered cylindrical roller 120, beyond which are a plurality of idler rollers 122 arranged to form a downwardly inclined, low friction ramp 124 leading to a discharge conveyor 126.

Figure 4:
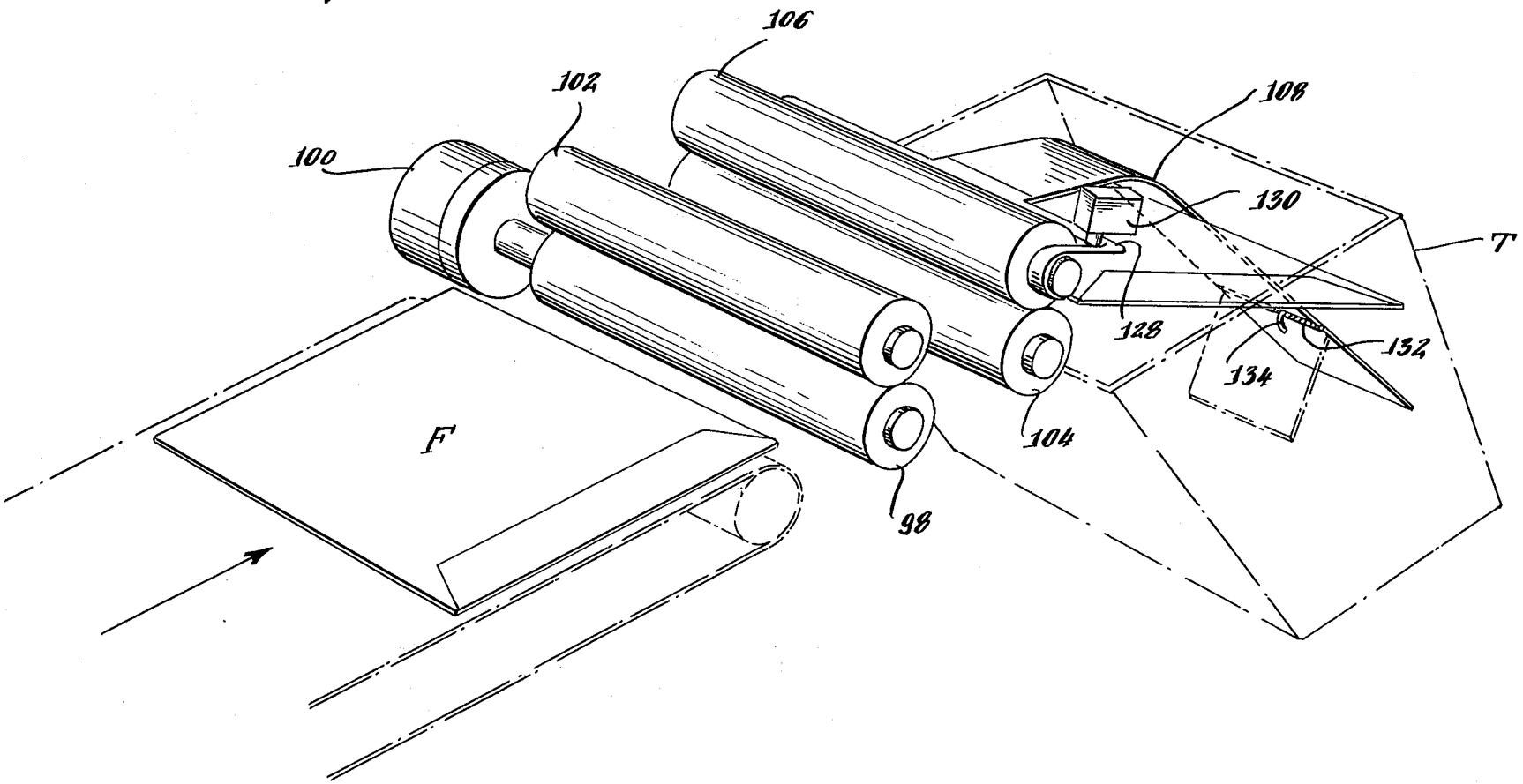
FIG. 4 is an enlarged detail of the loading mechanism of one of the stations of FIG. 3; and, FIG. 5 is a schematic diagram of an overall system incorporating the present invention.

Before proceeding to an explanation of the operation of this invention, attention is directed to FIG. 4 which discloses the quide plate 108 which extends downwardly into the trays. This guide plate may be pivotally mounted by any suitable means such as the yoke 128. The lower end of the guide plate 108 extends into the tray T to rest against mail pieces therein and the yoke 128 is positioned to activate a switch 130. The lower end of the guide plate 108 is hinged, as by hinge 132 which will operate in the direction indicated by the dotted lines but which is normally held outwardly by the action of a spring 134.

Operation

A. Transfer Function

Mail flats are fed inwardly from the left as shown in FIG. 1 so as to be scanned by the photodetector 26. This photodetector observes if the postage indicia is at the leading edge of the flat or its trailing edge and whether it is at the top or the bottom edge. Based upon the results of this scan, the controller 28 will cause the gates 30, 32 to assume the correction positions. It will be understood that either set of transfer stations may accept leading or trailing edge postage indicia. However, for purposes of explanation, it will be assumed that the first pair of transfer stations, i.e., stations 10, 12, will accept flats bearing postage indicia adjacent the leading edge. It will also be assumed that the "normal" position for postage indicia is in the upper right hand corner as one views the address side of the flat.

Assume that a flat F2 passes through the gap 24 with its postage indicia in the upper right hand corner as viewed by an observer at position X of FIG. 1. Under these conditions, the controller 28 will cause both gates 30, 32 to pivot downwardly into the positions illustrated by solid lines. The flat F2 will thereby be forced through pathway 48 and into transfer station 12. If the postage indicia of another flat is also adjacent the leading edge, but at the bottom, the gate 30 will be triggered to its upwardly pivoted position so that the flat will pass through path 34 and into station 10. If neither condition is met, gate 30 will remain down and gate 32 will be pivoted upwardly so as to pass a flat meeting neither condition through the "reject" path 70, thereby bypassing both transfer stations 10 and 12.

FIG. 2 illustrates the flats advancing into transfer station 10. These flats have the postage indicia along the loading edge but at the bottom. They are advanced by belts 44*a, b,* past the aperture 86 and against the deflector 92*a* so that they are caused to fall downwardly through a 90° arc onto the conveyor 84 as illustrated. As viewed looking down onto the incoming conveyor, the postage indicia will be in the upper right hand corner. Similarly, the flats directed into station 12 will be deflected backwardly so as to fall onto the conveyor 84 as shown in FIG. 2 so that all flats upon conveyor 84 will be aligned in the same fashion.

The rejects, which have passed through stations 10 and 12, will include all flats having properly positioned indicia along the tailing edges. These are handled in exactly the same manner by the second pair of transfer stations, although the indicia of the flats on the belt 84' will be on the bottom as shown in FIG. 3. Flats whose postage indicia do not meet either of the criteria required for the first or second pair of stations will be advanced onto a reject path where they may be handled manually or as desired.

B. Tray Loading

Referring now to FIG. 3, it will be noted that there are two conveyors 110, 110' onto which postal trays T may be loaded, manually or otherwise, for downward movement along the incline of the conveyors. Considering only the nearest loading station as viewed in FIG. 3, it will be seen that the flats F which are carried by conveyor 84 are fed into the bite between driven roller 98 and drag roller 102. The function of the drag roller is to singulate the mail so that only single flats thereafter pass between the ejector rollers 104, 106. These rollers are faster than the preceding rollers and propel each piece of mail into its associated tray T below the guide plate 108. As flats accumulate in the particular tray, guide plate 108 is gradually lifted until, when the tray is sufficiently full, the switch 130 is actuated to activate the conveyor 110 to advance the next tray into position. Simultaneously, brake/clutch 100 is energized to briefly stop roller 98 and the flow of mail pieces while the trays are positioned. The hinge 132 permits the end of the guide plate 108 to deflect and permit the passage of the tray rim. It then returns to its original position for insertion in the succeeding tray.

Upon advancement of the next tray into the loading position, the bottommost loaded tray on the conveyor 100 will be advanced onto the belts 114 and carried to the powered conical rollers 118. As the large diameter ends of these conical rollers have a faster peripheral speed than their small diameter ends, each of the loaded trays received thereon is caused to pivot through a 90° arc and into contact with cylindrical roller 120. Roller 120 propels the loaded tray onto the ramp 124 where it rolls onto the discharge conveyor 126.

If the position of the postage indicia is now traced through the sequence of operation just described, it will be noted that the postage indicia of all flats in the loaded tray now face downstream of conveyor 126 and are positioned in the upper left corner as the illustration is viewed. The operation of the loading station 96 is similar except that the 90° rotation of the loaded trays is in the opposite direction. If a similar analysis of the movement of the flats is made of this loading station, it will be seen that the loaded tray which is positioned on the conveyor 126 from the ramp 124' carries flats aligned identically to those from the preceding station.

C. System Operation

Figure 5:
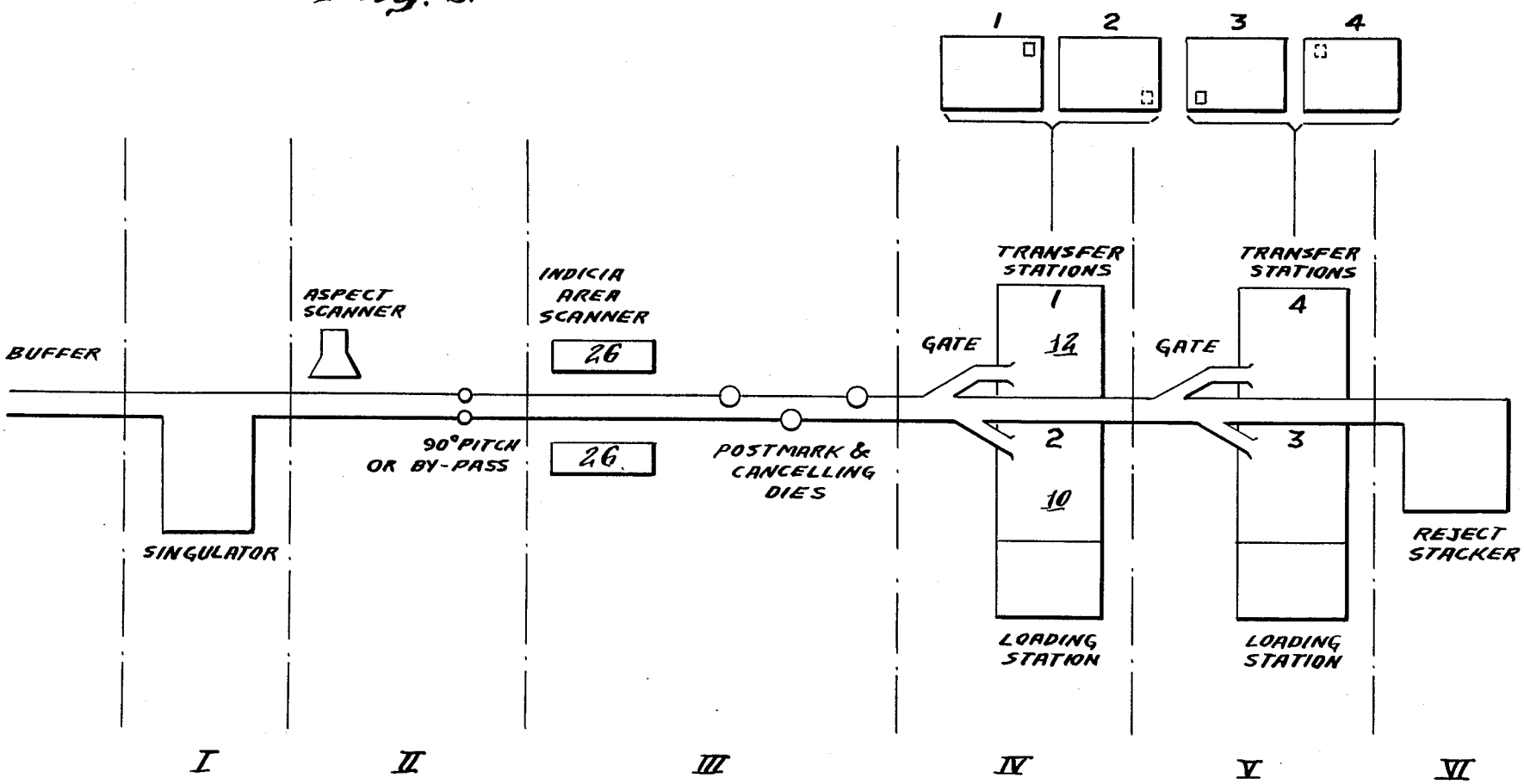

FIG. 5 illustrates the manner in which the apparatus of this invention may be incorporated into an overall system. The various functions of the system are denominated by Roman numerals I–VI. The specific functions of the present invention are incorporated in III–V, although a postmark and canceling station are included between photodetector 26 and the first transport apparatus 14. The numbers 1-4 identify the postage indicia locations which are handled by each of the transfer stations.

Conclusion

It will now be apparent that all of the objectives set forth above are achieved by the present invention. It will also be apparent that these objectives are achieved with simple and inexpensive apparatus as compared with those of the prior art. It will also be apparent that many variations and modifications may be made in this invention without departing from its spirit and scope. Accordingly, the foregoing description is to be construed as illustrative only, rather than limiting. This invention is limited only by the scope of the following claims.

What is claimed is:

1. Apparatus for loading flat mail pieces bearing corner positioned postage indicia in either of two orientations into receptacles in either of two loading positions and discharging the loaded receptacles with uniformly faced mail therein comprising:

a first loading station;

means for delivering mail pieces edge first to said first loading station with each having its postage indicia positioned on its upper surface adjacent its trailing edge relative to its direction of movement;

means for sequentially supplying said receptacles for loading at said first loading station;

means at said first loading station for inserting said mail pieces in said receptacles in edge-standing relationship with their postage indicia adjacent their upper edges;

means for sequentially discharging loaded receptacles from said first loading station with a preselected orientation relative to the postage indicia locations of the mail pieces therein;

a second loading station;

means for delivering mail pieces edge first to said second loading station with each having its postage indicia positioned on its lower surface adjacent its trailing edge relative to its direction of movement;

means for sequentially supplying said receptacles for loading at said second loading station;

means at said second loading station for inserting said mail pieces in said receptacles in edge-standing relationship with their postage indicia adjacent their upper edges; and, means for sequentially discharging loaded receptacles from said second loading station with the same orientation as receptacles from said first loading station.

2. The apparatus of claim 1 wherein said discharging means comprises single conveying means for receiving receptacles from both of said first and second loading stations.

3. The apparatus of claim 2 wherein said discharging means comprises means for angularly reorienting each of said receptacles between its loading position and its position on said conveying means.

4. The apparatus of claim 1 wherein the paths of said delivering means supplying said first and second loading stations are parallel.

5. The apparatus of claim 4 wherein the flows of mail pieces supplied by both of said delivering means are in the same direction.

6. The apparatus of claim 5 wherein the means for supplying receptacles to said first and second loading stations comprise respective first and second conveyors movable in a direction opposite the direction of flow of said mail pieces.

7. The apparatus of claim 6 wherein said discharging means comprises single conveying means for receiving receptacles from both of said first and second loading stations.

8. The apparatus of claim 7 wherein said discharging means comprises means for angularly reorienting each of said receptacles between its loading position and its position on said conveying means.

9. The apparatus of claim 1 wherein each of said delivering means orients flat mail pieces serially received in a generally edge-standing configuration and bearing corner positioned postage indicia commonly adjacent the leading or trailing edges and comprises:

means for sensing the location of said postage indicia relative to the vertical dimension of each piece;

a first transfer station;

means for transporting mail pieces having upper edge located indicia to said first transfer station in a first direction;

a second transfer station;

means for transporting mail pieces having lower edge located indicia to said second transfer station in a second direction substantially parallel to said first direction;

means for conveying mail pieces away from said first and second transfer stations in a third direction to one of said loading stations;

means at said first transfer station for depositing mail pieces onto said conveying means in a preselected orientation relative to said third direction;

and means at said second transfer station for depositing mail pieces onto said conveying means in the same orientation relative to said third direction as mail pieces from said first transfer station.

10. The apparatus of claim 9 wherein the direction of travel of mail pieces to said first transfer station is substantially the same as the direction of travel of mail pieces to said second transfer station.

11. The apparatus of claim 9 wherein said conveying means comprises a belt underlying each of said transfer stations.

12. The apparatus of claim 9 wherein each of said transfer stations defines a mail piece receiving aperture overlying said conveying means.

13. The apparatus of claim 12 wherein each of said transfer stations comprises means for deflecting each of said mail pieces from its edge-standing configuration and downwardly through said aperture to a flat position on said conveying means.

14. The apparatus of claim 13 wherein each of said mail pieces is deflected through an arc of approximately 90°.

15. The apparatus of claim 13 wherein the direction of mail piece deflection at said first transfer station is substantially opposite the direction of mail piece deflection at said second transfer station.

16. The apparatus of claim 15 wherein said conveying means comprises a belt underlying both of said transfer stations.

17. Apparatus for orienting flat mail pieces serially received in a generally edge-standing configuration and bearing corner positioned postage indicia commonly adjacent the leading or trailing edges comprising:

means for sensing the location of said postage indicia relative to the vertical dimension of each piece;

a first transfer station;

means for transporting mail pieces having upper edge located indicia to said first transfer station in a first direction;

a second transfer station;

means for transporting mail pieces having lower edge located indicia to said second transfer station in a second direction substantially parallel to said first direction;

means for conveying mail pieces away from said first and second transfer stations in a third direction;

means at said first transfer station for depositing mail pieces onto said conveying means in a preselected orientation relative to said third direction;

and means at said second transfer station for depositing mail pieces onto said conveying means in the same orientation relative to said third direction as mail pieces from said first transfer station.

18. The apparatus of claim 17 wherein said conveying means comprises a belt underlying each of said transfer stations.

19. The apparatus of claim 17 wherein each of said transfer stations defines a mail piece receiving aperture overlying said conveying means.

20. The apparatus of claim 19 wherein each of said transfer stations comprises means for deflecting each of said mail pieces from its edge-standing configuration and downwardly through said aperture to a flat position on said conveying means.

21. The apparatus of claim 20 wherein each of said mail pieces is deflected through an arc of approximately 90°.

22. The apparatus of claim 20 wherein the direction of mail piece deflection at said first transfer station is substantially opposite the direction of mail piece deflection at said second transfer station.

23. The apparatus of claim 22 wherein said conveying means comprises a belt underlying both of said transfer stations.

* * * * *